US007628872B2

(12) United States Patent
Zhang et al.

(10) Patent No.: US 7,628,872 B2
(45) Date of Patent: Dec. 8, 2009

(54) LEAD-FREE FREE-CUTTING COPPER-ANTIMONY ALLOYS

(75) Inventors: Ming Zhang, Zhejiang (CN); Siqi Zhang, Zhejiang (CN); Jihua Cai, Zhejiang (CN); Haorong Lou, Zhejiang (CN); Xiao Xie, Zhejiang (CN)

(73) Assignee: Ningbo Powerway Alloy Material Co., Ltd., Ningbo, Zhejiang Province (CN)

( * ) Notice: Subject to any disclaimer, the term of this patent is extended or adjusted under 35 U.S.C. 154(b) by 392 days.

(21) Appl. No.: 10/572,222

(22) PCT Filed: Jun. 11, 2004

(86) PCT No.: PCT/CN2004/000625

§ 371 (c)(1),
(2), (4) Date: Mar. 17, 2006

(87) PCT Pub. No.: WO2005/071123

PCT Pub. Date: Aug. 4, 2005

(65) Prior Publication Data

US 2006/0289094 A1 Dec. 28, 2006

(30) Foreign Application Priority Data

Jan. 15, 2004 (CN) ..... 2004 1 0015836

(51) Int. Cl.
*C22C 9/04* (2006.01)
*C22F 1/08* (2006.01)

(52) U.S. Cl. ..... 148/434; 148/554; 148/680; 148/681; 148/682; 148/683; 420/477; 420/478; 420/479; 420/480; 420/481; 420/482; 420/483; 420/484

(58) Field of Classification Search ..... 148/434, 148/554, 680–683; 420/477–484
See application file for complete search history.

(56) References Cited

U.S. PATENT DOCUMENTS

| | | | | | |
|---|---|---|---|---|---|
| 5,487,867 | A | * | 1/1996 | Singh | 420/471 |
| 5,630,984 | A | | 5/1997 | Waschke et al. | 420/478 |
| 5,653,827 | A | | 8/1997 | Kramer et al. | 148/433 |

FOREIGN PATENT DOCUMENTS

| | | | | |
|---|---|---|---|---|
| EP | 0711843 | A2 | | 5/1996 |
| JP | 56-29643 | A | | 3/1981 |
| JP | 60086253 | | * | 5/1985 |
| JP | 63-130738 | A | | 6/1988 |

* cited by examiner

*Primary Examiner*—Sikyin Ip
(74) *Attorney, Agent, or Firm*—Global IP Services; Tianhua Gu

(57) ABSTRACT

A lead-free free-cutting copper-antimony alloy comprises in percentage by weight: 55 to 65% Cu, 0.3 to 2.0% Sb, 0.2 to 1.0% Mn, at least two elements selected from the group of Ti, Ni, B, Fe, Se, Mg, Si, Sn, P and rare-earth metal in amount of 0.1-1.0%, as well as balance Zn and unavoidable impurities. The brass alloys according to the present invention possess superior cutting property, weldability, corrosion resistance, dezincification resistance and high-temperature-oxidation resistance, and are suitable for use in drinking-water installations, domestic appliances, toy for children, fastener, etc. The process for producing such alloys is also proposed.

5 Claims, 1 Drawing Sheet

| Cutting Scrap Shape of First Alloy | Cutting Scrap Shape of Second Alloy | Cutting Scrap Shape of Third Alloy | Cutting Scrap Shape of Forth Alloy | Cutting Scrap Shape of C36000 Alloy |
|---|---|---|---|---|
|  |  |  |  |  |

LEAD-FREE FREE-CUTTING COPPER-ANTIMONY ALLOYS

FIELD OF THE INVENTION

The present invention generally relates to lead-free copper alloys and, more particularly, to lead-free free-cutting copper-antimony alloys with excellent machining property, workability and high corrosion resistance. Also, the present invention relates to leadless free-cutting copper-antimony alloys particularly suited for use in the area of cast components, water fixtures, pipe joints, faucet extensions, valves in water supply system, and plug connectors or connector contacts in electrical and electronic apparatus, toys, and the fasteners in car manufacture. And also the present invention alloys can replace present lead-containing brass widely being used in nowadays, which severely influence the health of human body, and threatening the safety of the environment.

BACKGROUND OF THE INVENTION

It is well-known that Lead-contained copper alloy is an important basic material which are widely used in machine-made industry such as drinking-water installations, in particular for the manufacture of fittings, connecting castings and its spares which continuously contact with drinking water for human consumption. In recent years the experts of medicine in various countries have discovered that the Pb-contained brass severely influence the health of human body, and is threatening the safety of the environment. The academy and research institutes of medicine in north Europe, America, Japan, and China have been reporting the concerns focused on Pb-containing brass threatening the human environment in recent years.

Ingestion of lead by humans is harmful, therefore the use of lead is being strictly banned due to the concerns on health and environment. Drinking water is one such concern and legislation has been proposed to reduce the concentration of lead in particular in connection with drinking-water system, plumbing fixtures and fittings and thus to reduce the amount of lead leached into the water. Accordingly, there have been attempts to reduce the lead content of alloys and numerous elements have been proposed as substitutes for lead.

Chinese Pat. No. 02121991.5 discloses one such alloy invented by Mitsukoshi Ltd. of Japan that contains 60.0 to 62.0% Cu, 0.5 to 2.2% Bi, 0.01 to 0.1% Al, 0.5 to 1.6% Sn, 0.04 to 0.15% P and the balance Zn with unavoidable impurities. The alloy is annealed for 30 minutes to 4 hours in a range from 460° C. to 600° C., and then cooled with a speed under 70° C./h. It is a lead-free Cu—Zn—Bi alloy, because within which Bi is an element, however, Bi increases the production cost, and its resource in the global is exhaustible, therefore, the lead-free free-cutting alloy containing bismuth is not a competitive product.

SUMMARY OF THE INVENTION

The object of the present invention is to provide a lead-free free-cutting copper-antimony alloy which does not contain the harmful element lead, or contains an extremely small amount of lead for improving machinability. The invented alloy is excellent in machinability, cold and hot moldability, good weldability, machinability, good corrosion resistance, and it can replace Pb containing copper alloy in wide uses. This lead-free free-cutting copper-antimony alloy makes us avoiding contamination to the environment. It is really an environment-friendly free-cutting copper-antimony alloy The present invention is realized by providing four copper alloys on a base of copper, zinc, antimony and other elements.

First Alloy

The first invention alloy comprises (in percentage by weight): 55 to 65% Cu, 0.3 to 2.0% Sb, 0.2 to 1.0% Mn, and the further elements 0.1 to 1.0%, (the said further elements comprise at least two elements selected from Ti, Ni, B, Fe, Se, Mg, Si, Sn, P, and earth elements,) the remainder Zn and unavoidable impurities. The said copper-based alloy contains (Cu %+Zn %) is above 97% and not equal to 100%, within which the content of Zn is above 35%.

A particularly preferred alloy of the first invention comprises in percentage by weight: 57 to 62% Cu, 0.5 to 1.5% Sb, 0.2 to 0.8% Mn, and the further elements 0.2 to 1.0%, (the said further elements comprise at least two elements selected from Ti, Ni, B, Fe, Se, Mg, Si, Sn, P, Re,) and the remainder Zn with unavoidable impurities, wherein the content (Cu %+Zn %) is above 97.5% and not exceeds 99%, and the content Zn is above 35%.

The phase-components of lead-free copper alloy of present invention is a hard-brittle phase structure, which mainly includes alpha phase and beta phase, and small quantity of antimonial intermetallic compound which is uniformly dispersed in the boundary of crystal grain or in the crystal.

It is utilized by first invention alloy that the antimony with lower melting-point has a certain extent of solid solubility in the matrix of copper, and has a characteristics of aggregating in the boundary of the crystal grains, it favors intermetallic compounds to disperse in the boundary of the crystal grains uniformly, it enable the alloy containing antimony to posses the machinability as good as a lead containing brass possessed, and with excellent dezincing resistance. (It is well known that at 630° C. the maximum solid solubility of antimony in the matrix of copper is 5.9%, while at 210° C. it is 1.1%.) (It is also well known by the skilled in the art that because of antimony existing in an alloy in the form of solid dissolution phase, it is not dissolvable in water, so it is non-toxic. And lead existing in an alloy in the form of toxic dissociating phase, which is prone to be emitted into water. To use the Pb-containing copper alloy in the drinking water supply installations is unfriendly to the environment.)

In addition, some other elements which would refine the crystal grains and suppress dezincification are added in along with antimony, which enable the hard brittle antimonial intermetallic compounds to be dispersed more finely and uniformly, and efficiently suppress the tendency of brittle fracture caused by the adding antimony and the formation of discontinuous chips during machining would be favored. The machinability, strength, plasticity, dezincification and corrosion resistance are greatly improved. It enable antimony copper alloy attaining a good machinability and other excellent workabilities.

It should be noted that in the case of the content of antimony lower than 0.3% by weight the formation of aggregation in the boundary of the crystal grains can not meet the industrial requirement for the high speed cutting workings, and provides no contribution to suppress dezincification. However, if the content of antimony Sb exceeds 2% by weight, the tendency of brittle fracture will be increased and the hot mouldability and cold mouldability will be greatly decreased.

Mn is necessary in order to influence the strength of solid solution and suppressing dezincification, especially in the case of existing Si and Fe, an intermetallic compound $Mn_5Si_3$ and iron-rich intensification phase in the boundary of the crystal grains would be formed. When the content of Mn is less than 0.2% by weight, the intensification would be decreased. If the content of Mn exceeds 1.0% by weight, the effect of intensification would be increased, but the cuttability would be influenced, and the discontinuous chips for the chips draw out are hard to be formed. However, the content of Mn is in the range from 0.2 to 1.0%, not only the intensification in the boundary of the crystal grains would be increased but also the cuttability and wear resistance of the alloy would be increased.

If the content of Zn is above 35%, the increment of the cuttability would be favored, however, the over content of Zn will have a negative effect on the cold mouldability of the alloy.

The effect of the adding at least two elements selected from Ti, Ni, B, Fe, Se, Mg, Si, Sn, P, Re firstly is deoxidization for refining the crystal grains, secondly is to form hard brittle phase with the elements including antimony in order to enable the hard brittle phase of Sn-containing intermetallic compounds to be dispersed more finely and more uniformly, thus, effectively suppress the tendency of brittle fracture caused by the aggregation of antimony in the alloy, enable the alloy to be formed discontinuous chips during the cutting in proceeding. Hence the industrial requirement for excellent cuttability, hot and cold formability and weldability are acquired. Thirdly, the dezincification is suppressed, and corrosion resistance is increased. If the total contents of at least two elements mentioned above is less than 0.1%, the intensification effect in the boundary of the crystal grains and satisfied cutting effect would fail to be attained. If the total contents of at least two elements mentioned above exceeds 0.1%, the crystal grains will be further refined, which may help to improve cuttability, but the cold formability in the after sequence would not be satisfied due to the formation of other hard brittle phase, hence the cost of manufacturing would be increased, it would badly influence the spread of using the alloy.

Adding Ti, Ni, and Mg could deoxidize the molten metal, refine the crystal grains, prevent the development of columnar crystal, combine with the low melting-point element antimony to form high melting-point intermetallic compounds, which preferentially disperse in the boundary of the crystal grains, and enable the antimonial intermetallic compounds to be finely and uniformly dispersed in the boundary of the crystal grains and in the crystal grains, suppressing the tendency of brittle fracture of the alloy and, helping the formation of discontinuous chips during machining. Hence, excellent cuttability of the alloy is attained; also the strength and plasticity and corrosion resistance and stress corrosion resistance and oxidation resistance are improved.

In general, the total amount of addition of the three elements above mentioned is in the range of 0.01 to 0.6% by weight. Ni is in the middle or lower range, and the content of Ti and Mg may be in the lower range. The production cost would be increased if the amount of addition of Ti and Ni exceeds 0.6% by weight. If the content of Mg exceeds 0.2% by weight, the cold formability would be influenced. Fe, B, and Re also help to refine the crystal grains, prevent the grains from development, limit the quantity of transforming β phase, to form intermetallic compounds, and to increase the softening point, to improve strength, and to raise the hot formability and cold formability. In particular, the atomic radius of B is smaller than that of Zn (the atomic radius of B is $0.88\times10^{-10}$ m, while the atomic radius of Zn is $1.33\times10^{-10}$ m). Thereby when brass is in corrosion, B atomics are more prone to be diffused than Zn atomics. That is to say, B atomics have the chance to preferentially occupy the vacancies and block up the diffusing passages of Zn atomics, then the diffusing resistance of Zn atomics is increased, and finally form a protective film to prevent it from corrosion, thus the excellent effect to suppress brass from the dezincification is attained just like arsenic element can do. If the content of B is less than 0.012% by weight, B exhibits satisfactory dezincification.

B element works on promoting the dynamic re-crystallization of the alloy, and improving the mouldability of the alloy, the suitable content of B is in the range of 0.0001 to 0.12%.

Rare earth metal is a good inoculant and a refining cleaner, and it hardly solid solution in copper. Re combines with Bi and Sb in the matrix to form high-melting intermetallic compounds and being dispersed in the crystal grains to raise plasticity and wear resistance, suppress the tendency of brittle fracture of the alloy, and refine the crystal grains. The content of Re in the general is in the range of 0.003 to 0.3% by weight. The optimum effect will be exhibited if mixed rare earths on the basis of lanthanum are added. The addition of Re is also capable of increasing electrical conductivity, dezincification, and corrosion resistance, but over content of Re will decrease the flow of molten metal in casting.

The content of Si is mainly to deoxidize the molten metal, and improve the flow of the molten metal in casting, forming intermetallic compounds, and increasing the strength of the alloy, instead of forming the silicon-rich y phase in the matrix, the adding amount is in the range of 0.2 to 0.8%, it is favor that the uniform dispersing of the antimony containing metallic compounds and the improvement of cuttability and weldability, and helps the formation of discontinuous chips during machinig. The content of Se, Sn, and P is for improving the cuttability. In particular, Sn and p have an important effect on suppressing dezincification. The content of Se and P must be controlled in the range of 0.005 to 0.2% by weight, the content of Sn is 0.2 to 0.4% by weight, the over content thereof will affect cold workability and increase production cost.

As is described above, the first alloy of present invention is a lead-free free-cutting Copper-antimony alloy with excellent hot mouldability and cold mouldability and mechanical properties and favorable machinability and weldability.

Second Alloy

The second lead-free free-cutting copper alloy comprises (in percentage by weight): 55 to 65% Cu, 0.3 to 1.5% Sb, 0.1 to 0.6% Ni, 0.0004 to 0.12% B, if Sb content is less than the middle of the range, Ni may not to be used as the major constituent, and 0.2 to 1.0% other elements, (the other elements comprise at least two elements selected from Ti, Fe, Sn, Al, Li, Mg, Re, P) and the remainder Zn with unavoidable impurities, wherein the content (Cu %+Zn %) is above 97% but not equal to 100%, and the Zn content is above 35%.

A particularly preferred alloy of the second invention comprises (in percentage by weight): 58 to 63% Cu, 0.4 to 1.0% Sb, 0.2 to 0.4% Ni, 0.0005 to 0.015% B, if content Sb is less than the middle of the range, Ni may not to be used as the major constituent, other elements are 0.35 to 0.8%, (the other elements comprise at least two elements selected from Ti, Fe, Sn, Al, Li, Mg, Re, P,) and the remainder Zn with unavoidable impurities. The content (Cu %+Zn %) is above 97.5% but not exceeds 99%, and the content Zn is above 35%.

The alloy of second invention has a metal structure with α phase and β phase in large quantities and hard brittle phase of antimony-containing intermetallic compounds that finely and uniformly disperse in granular form in the boundary of the crystal grains in a small quantity.

It is the mechanism used by the second alloy that Sb is a metal with lower melting-point, and which has a certain solid solubility in the matrix Cu (at 630° C. its maximum solid solubility is 5.9% by weight, while at 210° C. its maximum solid solubility is 1.1% by weight. Sb exists in alloy in the form of non-toxic solid solution.

And Sb is not dissolvable in water, it does not like Pb which exists in the alloy in the form of free toxic element and is prone to be dissolved in water) and also owing to the characteristic of aggregating in the boundary of the crystal grains, the antimonial intermetallic compounds uniformly being dispersed in the boundary of and in the crystal grains is favored. Hence, the antimony-contained copper alloy not only possesses excellent machinability like lead-containing copper alloys having, but also specifically possesses favorable dezincification corrosion resistance.

In view of above grounds, the addition of some other elements which would refine the crystal grains and suppress dezincification along with antimony could make the hard brittle phase of antimonial intermetallic compounds disperse more finely and uniformly, thus, it enable the tendency of brittle fracture caused by the addition of antimony effectively to be suppressed, therefore, help the formation of discontinuous chips during machining. The machinability and strength and plasticity and dezincification corrosion resistance of the alloy are increased, meanwhile enabling the lead-free free-cutting copper-antimony alloy to acquire excellent cuttablity like lead-containing copper alloys possessing and some other excellent performances.

If the content antimony is less than 0.3% by weight, it can not meet the industrial requirements for favourable machinability and enables the dezincification not to be suppressed. However, if the amount of the addition of Sb exceeds 1.5% by weight, the tendency of brittle fracture will be raised and the consequently cold mouldability will be influenced.

The addition of Ni has the effects of strengthening matrix and suppressing dezincification. The addition of Ni also has the effects of enhancing strength and plasticity and corrosion resistance and stress corrosion resistance of the alloy. If the content Ni is less than 0.1% by weight the industrial requirement for various performances hard to be satisfied. Mass production cost would be increased when the addition of Ni exceeds 0.6% by weight. Thus the addition of Ni is set in the range of 0.1 to 0.6% by weight, element B is added to the alloy to be as a major component.

It is noted that the atomic radius of B is smaller than that of Zn (the atomic radius of B is $0.88\times10^{-10}$ m, while the atomic radius of Zn is $1.33\times10^{-10}$ m). Thereby when brass is eroded, B atomics are more prone to diffuse than Zn atomics. That is to say, B atomics have the chance to preferentially hold the vacancy and block up the diffusing passage of Zn atomics, thus, increase the diffusing resistance of Zn atomics, and finally the protective film is formed to suppress dezincification. Through this way, the addition of B could attain the same optimum effect of suppressing dezincification as the addition of As (Arsenic) could.

Besides adding B the addition of Sn and some other elements would further improve the dezincification and corrosion resistance of the alloy, which meet the present international standard about the leaching quantity of Cu, Zn, and Sb in drinking-water. If the content of Zn is above 35% by weight the improvement of machinability would be favored, but overcontent will bring a negative effect on the cold mouldability of the alloy.

As to the function of adding at least two elements selected from Ti, Fe, Sn, Al, Li, Mg, Re P, firstly, the deoxidization of the molten metal and the suppression of dezincification and refining the crystal grains are favored. Secondly, they could combine with antimony to form high-melting hard brittle phase of the antimonial intermetallic compounds with high melting-point and distribute to effectively control the soft ability and hard ability of the alloy, enabling the Sb-containing grains to disperse in boundary of crystal and in crystal more finely and more uniformly, thereby the discontinuous chips are formed during machining. Hence the alloy has excellent machinability, corrosion resistance, dezincification, weldability, favourable hot and cold formability. If the total content of other elements are less than 0.1% by weight, the satisfied strengthening effect and favourable machinability will not be realized. If the total content of other elements exceeds 1.0% by weight, although the crystal grains will be further refined, the cuttability being improved, but the cold formability would not be favored. which will have a negative effect on the increment of mass product cost, the spread effect would be influenced.

The addition of Ti, Mg, and Li could deoxidize the molten metal, refine the crystal grains, and prevent columnar crystal from development, combine with the lower melting-point element antimony and the like substances to create high melting-point intermetallic compounds, and preferentially disperse in the boundary of the crystal grains, prompt the antimonial intermetallic compounds uniformly disperse in the boundary of and in the crystal grains, suppress the tendency of brittle fracture of the alloy. Hence, excellent cuttability of the alloy is attained, also the strength and plasticity and corrosion resistance of the alloy are improved. Total content of the three elements is in the range of 0.001 to 0.14% by weight. If the amount of the three elements is in the low side of the range, various favorable performances will be decreased. In contrast, if the amount of the three elements is in the high side of the range, the plasticity will be decreased, and it is uneconomical.

Fe also favors refining the crystal grains, improving plasticity and strength but decreases corrosion resistance. If Fe is added in amount less than 0.1% by weight, the requirement of intensifying strength can not be achieved, and if the addition exceeds 0.3% by weight, corrosion resistance will be decreased. So, the amount of addition of Fe is set in the range from 0.1 to 0.3% by weight.

The purposes of adding the elements Sn, Al, P, and Re is mainly for attaining the optimally match with B to improve dezincification, corrosion resistance, stress corrosion resistance and strength, and also for deoxidizing the molten metal and enhancing the cuttability.

The addition of Sn has the effects of strengthening solid solution and suppressing dezincification. The addition of Sn along with B, Al, and P could strengthen the matrix, favoring different phases with dispersion uniformly in the matrix, improving strength and wear resistance and machinability, in particular, enhancing dezincification corrosion resistance and stress corrosion resistance. The addition of Sn is preferably set in the range of 0.2 to 0.5% by weight.

The addition of Al and P helps to not only deoxidize the molten metal and suppress dezincification, but also increase the flow of molten metal in casting, moreover, it helps the formation of discontinuous chips during machining. The addition of Al is usually set in the range of 0.15 to 0.4% by weight. If Al is added in amount less than 0.15% by weight or above 0.4% by weight, the stress corrosion resistance of the alloy will be weakened.

Preferably the addition of P is set in the range of 0.005 to 0.3% by weight. The overcontent of P and Sn would decrease the cold workability in the following process.

Rare earth metal is good inoculant and refiner cleaner and in the Copper matrix it could combine with impurities like Bi to form high-melting intermetallic compounds and disperse in the crystal grains to raise plasticity and wear resistance, and suppress the tendency of brittle fracture of the alloy, furthermore refine the crystal grains. Preferably the addition of Re is set in the range of 0.003 to 0.3% by weight. The optimum effect will be exhibited if rare earths is mixed on the basis of lanthanum being added. The addition of Re is also capable of increasing electrical conductivity, but overcontent of Re will decrease the flow of molten metal in casting.

As is described above, comprehensively the second invention alloy is a lead-free free-cutting copper-antimony alloy with excellent machinability and corrosion resistance and dezincification corrosion resistance, weldability and favourable hot mouldability and cold mouldability.

Third Alloy

The third invited alloy comprises (in percentage by weight): 55 to 65% Cu, 0.4 to 1.8% Sb, 0.3 to 1.5% Si, 0.0004 to 0.12% B, and at least two further elements 0.2 to 1.2%, (The at least two further elements are elected from Fe, Sn, Ni, Re, P, Mn, Al, Li) and the remainder Zn with unavoidable impurities, wherein the content (Cu %+Zn %) is above 97%, not equal to 100%, and the content Zn is above 33%

A particularly preferred alloy of the third invention comprises (in percentage by weight): 57 to 64% Cu, 0.6 to 1.2% Sb, 0.3 to 1.0% Si, 0.0005 to 0.015% B, and at least two further elements (0.2 to 1.0%) selected from Fe, Sn, Ni, Re, P, Mn, Al, Li, and the remainder Zn with unavoidable impurities, wherein the content (Cu %+Zn %) is above 97%, not exceeds 99%, and the content Zn is above 33%.

The third invention alloy has a metal phase structure with $\alpha$ phase and $\beta$ phase in large quantities and hard brittle phase of antimony-containing intermetallic compounds, which finely and uniformly disperse in a small quantity.

It is the mechanism utilized by the third alloy that Sb is a metal with lower melting-point, and which has a certain solid solubility in the matrix Cu (at 630° C. its maximum solid solubility is 5.9%, by weight, while at 210° C. its maximum solid solubility is 1.1%, by weight. Sb exists in alloy in the form of non-toxic solid solution. And Sb is not dissolvable in water, it does not like Pb which exists in the alloy in the form of free toxic element and is prone to be dissolved in water.) And possesses the characteristic of aggregating in the boundary of the crystal grains. It enables the antimony-containing intermetallic compounds uniformly to be dispersed in the boundary of crystal and in the crystal grains itself, thus, the antimony-containing copper alloy would possess the excellent cuttability as good as the brass having.

Simultaneously the further elements are added in order to enable the crystal grain being more finely, the dezincification can be suppressed. Therefore, the antimony-containing hard brittle phase would be dispersed more uniformly and more finely. The tendency of brittle fracture caused by adding Sb element would be suppressed, and help the formation of discontinuous chips during machining. Therefore the third invention alloy is improved in machinability and mechanical strength and plasticity. Meanwhile, the lead-free free-cutting copper-antimony alloy acquires not only excellent machinability like lead-contained copper alloys do but also some other excellent performances. Moreover, the tendency of dezincification is also effectively suppressed.

It is noted that antimony in an amount of less than 0.4% by weight can not meet the industrial requirement for favourable machinability and the suppression of dezincification would not be effected. However, if the content Sb exceeds 1.8% by weight, the tendency of brittle fracture will be raised and the machinability and other performances will be weakened The purpose of adding Si is mainly to deoxidize the molten metal, and improve the flow of the molten metal in casting, form intermetallic compounds, increase the strength and wear resistance of the alloy instead of forming the silicon-rich y phase in the matrix. The addition of Si is set in the range of 0.3 to 1.0% by weight. It favors the improvement of machinability and weldability and, also could suppress the evaporation of zinc vapor during welding and the slag impurities, the welding technological properties are greatly improved.

B is added to the alloy as major constituent. It is noted that the atomic radius of B is smaller than that of Zn (the atomic radius of B is $0.88\times10^{-10}$ m, while the atomic radius of Zn is $1.33'10^{-10}$ m). Thereby when brass is eroded, B atomics are more prone to diffuse than Zn atomics. That is to say, B atomics have the chance to preferentially hold the vacancy and block up the diffusing passage of Zn atomics, increase the diffusing resistance of Zn atomics. And finally the protective film is formed to suppress dezincification. Through this way, the addition of B could attain the same optimum effect of suppressing dezincification of brass as the addition of As could do. Besides the addition of B, the addition of Sn and some other elements would further improve the dezincification, corrosion resistance of the alloy, enable which to meet the present international standard about the leaching quantity of Cu, Zn, and Sb in drinking water.

B also works to prompt the dynamic recrystallization and improves the mouldability of the alloy. The addition of B is usually set in the range of 0.0004 to 0.12% by weight.

If the content of Zn is set above 33% by weight, it will benefit the improvement of machinability, but overcontent will have a negative effect on the cold mouldability of the alloy.

The effect of adding at least two elements selected from among Fe, Sn, Ni, Re, P, Mn, Al, Li is that: firstly, they help to deoxidize the molten metal and refine the crystal grains; secondly, they could combine with antimony to form high-melting brittle antimonial intermetallic compounds and effectively control the degree of softening and brittleness, serve to make the brittle antimonial intermetallic compounds disperse more finely and uniformly. Hence the alloy has excellent machinability and weldability and corrosion resistance and favourable hot mouldability and cold mouldability. If the at least two elements mentioned above are added in amount less than 0.1% by weight, satisfying strengthening effect and excellent machinability will be weakened. However, if the addition exceeds 1.0% by weight, the crystal grains will be further refined, which may help to improve machinability but could also have a negative effect on the consequent cold mouldability and it is uneconomical, in other word, the generalization and application of the alloy will be affected.

The addition of Manganese has the effects of strengthening solid solution and suppressing dezincification. In particular, the addition of Mn along with Si and Fe would form an intermetallic compound $Mn_5Si_3$ and iron-rich phase in the boundary of the crystal grains. Decreased strengthening effect is exhibited when Mn is added in amount less than 0.2% by weight. If the addition of Mn exceeds 1.0% by weight, improved strengthening is effected but decreased machinability are exhibited, the chips drawn out and discontinuous chips are hard to form. So the suitable amount of addition of Mn is set in the range from 0.2 to 1.0% by weight to strengthen the boundary of the crystal grains, and to improve the machinability, and also the wear resistance of the alloy, the corrosion resistance in salt fog atmosphere and in chlorine media could be improved.

The addition of Ni has the effects of strengthening matrix and suppressing dezincification. The addition of Ni also has the effects of enhancing strength and plasticity and corrosion resistance. Ni in an amount of less than 0.1% by weight can not meet the industrial requirement for various performances. Mass production cost is increased when the content of Ni exceeds 0.6% by weight.

Fe and Re help to refine the crystal grains, prevent the development of the grains, limit the transforming quantities of β phase, form intermetallic compounds, increase the softening point, improve the strength and hot and cold mouldability of the alloy. The addition of Fe is controlled in the range from 0.1 to 0.3% by weight. If the addition exceeds 0.3% by weight, corrosion resistance will be decreased. Rare earth metal is good inoculant and refining cleaner and is hard to possess a solid solubility in copper. Re combines with Bi and Sb in the matrix to form high-melting intermetallic compounds and disperse in the grains to raise plasticity and wear resistance, suppress the tendency of brittle fracture of the alloy, refine the crystal grains. The content of Re is usually set in the range from 0.003 to 0.3% by weight. The optimum effect will be exhibited if mixed rare earths on the basis of lanthanum added. The addition of Re is also capable of increasing electrical conductivity and dezincification resistance, but overcontent of Re will decrease the flowability of molten metal in casting.

The addition of Li could deoxidize the molten metal, refine the crystal grains, prevent the development of columnar crystal, combine with the low-melting-point element antimony to form high melting-point intermetallic compounds and preferentially disperse in the boundary of the crystal grains, and enable the antimonial intermetallic compounds to finely and uniformly disperse in the boundary of crystal grains and therein, also to suppress the tendency of brittle fracture of the alloy Hence, excellent machinability of the alloy is attained, also the strength, plasticity, corrosion resistance of the alloy are improved. The addition of Li is set in the range from 0.001 to 0.014% by weight. If the amount of Li is set too low, various favorable performances will be decreased. By contrast, if the amount of Li is set too high, plasticity will be decreased and it is uneconomical. The addition of Sn, Al, and P is mainly to optimally match with B to improve dezincification corrosion resistance, stress corrosion resistance and strength. If B is added in amount less than 0.012% by weight along with Sn, Al, and P, the dezincification corrosion resistance of the alloy will be further enhanced, which could meet the present international standard about the leaching quantity of Cu, Zn, and Sb in drinking-water (standard about the leaching quantity of Cu, Zn, and Sb in the supply system carrying water for human consumption is: Cu≦0.2 mg/L, Zn≦0.2 mg/L, Sb≦0.0005 mg/L). Besides, the addition of B, Sn, P, and Al could deoxidize the molten metal and improve the machinability and strength of the alloy. Sn can strengthen solid solution and suppressing dezincification. The addition of Sn along with B, Al, and P can strengthen the matrix, enabling the different phases to uniformly disperse in the matrix and to form the intensifying phase, improving strength, wear resistance, machinability, in particular, enhancing dezincification corrosion resistance and stress corrosion resistance. The addition of Sn is set in the range from 0.2 to 0.5% by weight.

The addition of Al and P helps to not only deoxidize the molten metal and suppress dezincification, but also increase the flow of molten metal in casting, moreover, it helps the formation of discontinuous chips during machining. The content of Al is usually set in the range from 0.15 to 0.4% by weight. If Al is added in amount less than 0.15% by weight or above 0.4% by weight, the stress corrosion resistance of the alloy will be weakened. The preferred content of P is set in the range from 0.005 to 0.3% by weight. Too high content of P and Sn would decrease cold workability in the following process, Earth metal is a good inoculant and refining cleaner and it could combine with the impurities Bi etc, to form high-melting intermetallic compounds in Cu matrix and disperse in the grains to raise plasticity, wear resistance, suppress the tendency of brittle fracture of the alloy, and refine the crystal grains. The content of Re is set in the range from 0.003 to 0.3% by weight. The optimum effect will be exhibited if mixed rare earths on the basis of lanthanum are added. The addition of Re is also capable of increasing electrical conductivity, but overcontent of Re will decrease the flow of molten metal in casting.

As is described above, the third invention alloy is a lead-free free-cutting copper-antimony alloy with excellent machinability and corrosion resistance and dezincification corrosion resistance and weldability and having favourable hot mouldability and cold mouldability and mechanical properties. It really is a good alloy material for being used in drinking water supply engineering.

Fourth Alloy

The fourth invented alloy comprises 55 to 65%, by weight of Cu, 0.3 to 1.5%, by weight, of Sb, 0.16 to 0.45%, by weight, of Bi, at least two other elements selected from Sn, B, Li, Ti, Cr, Mg, Fe, P, Re, the other elements among 0.1 to 1.2%, by weight, and the remainder Zn with unavoidable impurities, wherein the percent by weight of (Cu %+Zn %) in the copper alloy is above 97% and not equal to 100%, content Zn is above 35%.

A particularly preferred alloy of the fourth invention comprises (in percentage by weight) 57 to 63% Cu, 0.5 to 1.2% Sb, 0.2 to 0.40% Bi, at least two elements selected from Sn, B, Li, Ti, Cr, Mg, Fe, P, Re; among 0.3 to 1.2% and the remainder Zn with unavoidable impurities, wherein the content (Cu %+Zn %) is above 97.5%, but not less than 99%, while Zn is greater than 35%.

The fourth invention alloy has a metal structure with α phase and β phase in large quantities and hard-brittle phase of antimonial-containing intermetallic compounds and bismuth-antimony compounds that finely and uniformly disperse in granular form in small quantities.

It is the mechanism utilized by the fourth invention alloy that owing to antimonial has solid solubility in the matrix (at 630° C. its maximum solid solubility is 5.9%, by weight, while at 210° C. its maximum solid solubility is 1.1%, by weight) (antimony does not like lead, does not exist in the matrix in the form of free toxic state but in the form of nontoxic solid solution, antimony does not dissolve in the water, while lead is prone to dissolve in the water) and, owing to antimonial characteristics of aggregating in the boundary of the crystal grains, the antimonial intermetallic compounds uniformly disperse in the boundary of and in the crystal grains. Hence, the antimony-contained copper alloy has excellent machinability like lead-contained copper alloys do. Also, the addition of some other elements which would refine the crystal grains and suppress dezincing along with antimony could make the brittle antimonial intermetallic compounds disperse more finely and uniformly and efficiently suppress the tendency of brittle fracture caused by the addition of antimony. That is, the antimony-containing copper alloy has excellent machinability like lead-contained copper alloys does, and the strength and plasticity are improved and the excellent weldability, casting performances, favourable hot and cold mouldability, some other various performances are increased.

It is noted that if the content antimony is less than 0.3% by weight, it can not meet the industrial requirement for favourable machinability. However, if the content Sb exceeds 1.5% by weight, especially exceeds 2% by weight, the quantity of harmful brittle fracture will increase and cold mouldability will be affected.

Bismuth does not form a solid solution in the copper, but it could combine with antimony to form intermetallic compounds and uniformly disperse in the matrix and in the boundary of the crystal grains. Better machinability is exhibited if bismuth is added along with antimony. But if bismuth is added in amount above 0.45% by weight, the hot and cold mouldability will be decreased, and production cost will be boosted. However, if the addition of bismuth is less than 0.16% by weight, it can not meet the requirement for improving machinability.

The addition of Zn is set above 35% by weight, the improvement of machinability being favored, but overcontent of zinc will have a negative effect on the cold mouldability of the alloy.

As is described above, at least two elements are selected from Sn, B, Li, Ti, Cr, Mg, Fe, P, and Re. The function of adding the at least two elements is, firstly, is that they help to deoxidize the molten metal and refine the crystal grains, secondly, is that they could combine with antimony to form high-melting hard-brittle phase of antimonial intermetallic compounds and serve to control the degree of softening and brittleness of the alloy, antimonial intermetallic compounds disperse in the boundary of crystal grain and in the grain more finely and uniformly. Hence the alloy possesses favourable machinability and hot and cold mouldability, excellent weldability, and corrosion resistance. If the at least two elements mentioned above are added in amount less than 0.1% by weight, satisfactory strengthening effect and excellent machinability will be weakened. However, if the addition exceeds 1.0% by weight, the crystal grains will be further refined, which may help to improve machinability but could also have a negative effect on the improvement of cold mouldability and it is uneconomical, in other word, the popularization and application of the alloy will be affected.

The addition of Sn has the effects of strengthening solid solution and suppressing dezincing. The addition of Sn along with P could strengthen the matrix, prompt different phases uniformly disperse in the matrix, improve strength and wear resistance and machinability. The addition of Sn is set in the range from 0.2 to 0.5% by weight. Overcontent of Sn will decrease the cold mouldability.

The addition of Li, Mg, Ti, and Cr could deoxidize the molten metal, refine the crystal grains, prevent the columnar grain growth, combine with the low melting-point element antimony to form high melting-point intermetallic compounds and disperse in the boundary of and in the crystal grains, prompt the antimonial intermetallic compounds finely and uniformly disperse in the boundary of the crystal grains and in the grain, also suppress the tendency of brittle fracture of the alloy.

Hence, favourable machinability of the alloy is attained, also the strength and plasticity and corrosion resistance and oxidation resistance of the alloy are improved. Total addition of the four elements is set in the range from 0.003 to 0.6% by weight.

The addition of Li, Cr, and Ti may be in the middle level or lower level of the range mentioned above, while the addition is beyond the upper level will boost the production cost. The content of Mg may be in the middle level.

Fe, B, P, and Re also help to refine the crystal grains, suppress dezincification, form intermetallic compounds, increase the softening point, improve strength and hot and cold mouldability.

The addition of Fe is set in the range 0.1 to 0.3% by weight. If the addition exceeds 0.3% by weight, corrosion resistance will be decreased. It is also noted that the atomic radius of B is smaller than that of Zn (the atomic radius of B is $0.88\times10^{-10}$ m, while the atomic radius of Zn is $1.33\times10^{-10}$ m). Therefore, when brass is eroded, B atomics are more prone to diffuse than Zn atomics. That is to say, B atomics have the chance to preferentially hold the vacancy and block up the diffusing passage of Zn atom increase the diffusing resistance of Zn atom. And finally the corrosion resistance protective film is formed to suppress dezincification. Through this way, the addition of B could attain the same optimum effect of suppressing dezincification as the addition of As could. If the addition of B is less than 0.012% by weight, the satisfactory dezincification and corrosion resistance can be attained. B works to favor the dynamic recrystallization of the alloy and improve the mouldability of the alloy.

The addition of B is usually set in the range 0.0001 to 0.12% by weight. P is added mainly to deoxidize the molten metal, improve the flow of the molten metal in casting, enhance the machinability of the alloy, and the addition of P is set in the range from 0.05 to 0.3% by weight.

Rare earth metal is a good inoculant and a refining cleaner and it hardly solution in copper. Re combines with Bi and Sb in Cu matrix to form high-melting intermetallic compounds and uniformly disperse in grains to raise plasticity, suppress the tendency of brittle fracture of the alloy, refine the crystal grains. The addition of Re is usually set in the range 0.003 to 0.3% by weight. The optimum effect will be exhibited if mixed rare earths on the basis of lanthanum are added, it is also capable of increasing electrical conductivity and dezincification, corrosion resistance, but overcontent of Re will decrease the flow of molten metal in casting.

As is described above, the fourth invention alloy is a lead-free free-cutting copper-antimony alloy with excellent machinability, favourable hot and cold mouldability and oxidation resistance.

The first to fourth invention alloys have greatly improved machinability and dezincing resistance because of the addition of antimony.

The first to fourth invention alloys, those alloy which are low in copper content mainly have a metal structure of $\alpha$ phase and $\beta$ phase and some other hard-brittle phase, antimonial intermetallic compounds in small quantities. The hard-brittle phase, antimonial intermetallic compounds finely and uniformly disperse and precipitate in boundary of grain and in crystal granular, and play the roll for strengthening precipitation. The machinability is raised. And the discontinuous chips are easily formed during machining. Moreover, the corrosion resistance and dezincing corrosion resistance wear resistance and cold and hot mouldability are enhanced.

In the first to fourth invention alloys even if lead exists in the alloy as an unavoided impurity, the content of Pb does not exceeds 0.03% by weight percentage.

The invention alloy, which is composed of (in percentage by weight): 55 to 65% Cu, 0.3 to 2.0% Sb, 0.2 to 1.0% Mn, other elements 0.1 to 1.0%, and reminder Zn and unavoidable impurities, which is manufactured by this way: special process of antimony-adding and covering protective methods are adopted in brass making, it could make antimony metal fast solution in the molten brass and form intermetallic compounds, then continuous casting proceeded at a temperature of about 1030° C. (it is known that the highest temperature of the whole smelting process of antimony-copper alloys is 1100° C., without reaching the vaporizing point 1675° C., so, it is safe to the environment), the extrusion with big rate proceeded in the range 630 to 720° C. and heat treatment proceeded in the range from 420° C. to 700° C., and relief annealing proceeded at a temperature of less than 400° C.

As compared with prior technology, the present invention has its own advantages, firstly, the first to fourth invention alloys are lead-free copper alloys with excellent machinability and dezincification, corrosion resistance, favourable weldability, corrosion and high-temperature oxidation resistance, extremely suit to be utilized as a work-piece to be machined, and in forgings and castings. Secondary, owing to its lower manufacturing cost, it is almost equivalent to the cost of currently making Pb-containing copper alloy. So, obviously it has strong competition capability. Thirdly, It enables the resource of antimony in our country fully developed and utilized in industry, the down stream industry of antimony metal would develop rapidly, the world market would be favored from it.

DETAILED DESCRIPTION OF THE PREFERRED EMBODIMENTS

Figure 1:
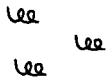
FIG. 1 shows the shapes of the cutting chips formed in cutting a round bar of copper alloy by lathe with a cutting depth of 0.5 mm.
Figure 1:
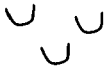
Figure 1:
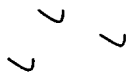
Figure 1:
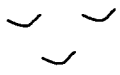
Figure 1:
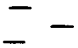

Now the detailed description to the invention is described below accompanying with the drawing.

EXAMPLES

The cylindrical ingots made of the first to fourth invention alloys with compositions given in table 11 to table 14 were hot extruded into a round bar to a needed size produce the test pieces, while a bar made of Pb-containing copper alloy C36000 which is made in U.S.A being a well-known brass with best cuttability was taken as a contrast test piece.

The tests are proceeded by comparison between the first to fourth invention alloys and the lead-containing C36000 alloy, the later is also experienced same treatment become an extruded test piece.

The manufacture processing of the invention alloys are as follows:

Preparing raw materials—continuous casting to make ingots—heating the casting ingots—extruding—drawn—heat treatment—acid washing—drawn—straightening and polishing—annealing to release stress—product inspection and packing In accordance with the present invention, relief annealing at a temperature In accordance with the present invention, relief annealing at a temperature of less than 400° C. is essential. The temperature of intermediate heat treatment must be varied in the light of the condition of different cold mouldability, but it must avoid the medium-temperature brittle zone.

The dimension of the ingot castings of the invention alloys is Φ170 mm in outside diameter and 400~500 mm in length. The ingot castings are hot extruded at different temperature from 630° C. to 720° C. under the same condition of extruding device the ingots are extruded into the wires or bars of Φ8 mm and Φ25 mm in outside diameter. The specific compositions of examples 1-001 to 1-005 of the first invention alloys are shown in Table 11 and the compositions of examples 2-006 to 2-010 of the second invention alloys are shown in Table 12 and the compositions of examples 3-011 to 3-015 of the third invention alloys are shown in Table 13 and the compositions of examples 4-016 to 4-020 of the fourth invention alloys are shown in Table 14.

Tests were conducted to evaluate various performances of the invention alloys:

To study the machinability of the first to fourth invention alloys in comparison with the conventional lead-containing alloy C36000, cutting tests were carried out.

TABLE 11

The composition of the first invention Pb-free free cutting alloy

| Example | alloy composition(wt %) | | | | | | | | | | | | | |
|---|---|---|---|---|---|---|---|---|---|---|---|---|---|---|
| No. | Cu | Sb | Mn | Ti | P | B | Ni | Se | Sn | Fe | Si | Mg | Zn | Impurity |
| 1-001 | 60.27 | 0.94 | 0.33 | | 0.010 | 0.001 | 0.223 | 0.15 | 0.18 | 0.19 | | 0.03 | Bal. | <0.2 |
| 1-002 | 61.20 | 0.62 | 0.26 | 0.06 | 0.12 | | 0.188 | 0.007 | | 0.21 | 0.351 | | Bal. | <0.2 |
| 1-003 | 61.28 | 0.86 | 0.78 | | | 0.0006 | | | | 0.24 | | | Bal. | <0.2 |
| 1-004 | 61.29 | 1.04 | 0.70 | 0.0002 | 0.006 | 0.003 | 0.0165 | | 0.22 | 0.14 | 0.215 | 0.0002 | Bal. | <0.2 |
| 1-005 | 60.8 | 0.98 | 0.49 | 0.004 | 0.015 | 0.0013 | 0.201 | 0.015 | 0.26 | 0.16 | | | Bal. | <0.2 |

TABLE 12

The composition of the second invention Pb-free free cutting alloy

| Example | alloy composition(wt %) | | | | | | | | | | | | |
|---|---|---|---|---|---|---|---|---|---|---|---|---|---|
| No. | Cu | Sb | Ni | Ti | Li | Sn | B | Fe | Al | P | Mg | Zn | Impurity |
| 2-006 | 58.21 | 0.75 | 0.23 | | | 0.336 | 0.0006 | 0.19 | 0.22 | 0.05 | 0.06 | Bal. | <0.2 |
| 2-007 | 60.33 | 0.52 | | 0.0012 | | | 0.0007 | 0.21 | 0.15 | 0.048 | 0.08 | Bal. | <0.2 |
| 2-008 | 58.80 | 0.66 | 0.20 | | | 0.210 | 0.0012 | | | 0.012 | 0.05 | Bal. | <0.2 |
| 2-009 | 59.80 | 0.65 | 0.18 | | | 0.274 | 0.0014 | 0.24 | 0.32 | 0.113 | 0.02 | Bal. | <0.2 |
| 2-010 | 60.24 | 0.96 | 0.22 | 0.0014 | 0.014 | | 0.0011 | | 0.13 | 0.050 | | Bal. | <0.2 |

TABLE 13

The composition of the third invention Pb-free free cutting alloy

| Example | alloy composition (wt %) | | | | | | | | | | | | |
|---|---|---|---|---|---|---|---|---|---|---|---|---|---|
| No. | Cu | Sb | Si | Mn | P | B | Fe | Sn | Ni | Li | Al | Zn | impurity |
| 3-011 | 62.51 | 0.76 | 0.72 | 0.20 | 0.081 | 0.002 | | 0.219 | | | | Bal. | <0.2 |
| 3-012 | 62.60 | 0.52 | 0.83 | | 0.007 | 0.005 | 0.16 | 0.209 | 0.15 | 0.008 | 0.23 | Bal. | <0.2 |
| 3-013 | 63.91 | 0.90 | 0.81 | | 0.133 | 0.008 | 0.22 | 0.316 | 0.23 | | | Bal. | <0.2 |
| 3-014 | 63.08 | 1.08 | 1.04 | 0.33 | 0.077 | 0.0007 | | 0.215 | | | 0.26 | Bal. | <0.2 |
| 3-015 | 61.17 | 0.937 | 0.37 | | 0.050 | 0.0007 | 0.18 | 0.211 | 0.24 | | | Bal. | <0.2 |

TABLE 14

The composition of the fourth invention Pb-free free cutting alloy

| Example | alloy composition(wt %) | | | | | | | | | | | | |
|---|---|---|---|---|---|---|---|---|---|---|---|---|---|
| No. | Cu | Sb | Bi | Ti | Cr | B | Li | Fe | Sn | Mg | P | Zn | impurity |
| 4-016 | 58.86 | 0.52 | 0.25 | 0.006 | | 0.0009 | 0.005 | | 0.42 | | 0.05 | Bal. | <0.2 |
| 4-017 | 59.02 | 0.96 | 0.30 | 0.010 | 0.07 | 0.014 | | 0.19 | | 0.04 | 0.11 | Bal. | <0.2 |
| 4-018 | 60.06 | 0.38 | 0.22 | 0.0384 | | 0.0006 | | | 0.23 | | 0.06 | Bal. | <0.2 |
| 4-019 | 59.82 | 0.81 | 0.21 | | 0.28 | 0.021 | 0.006 | 0.26 | 0.17 | | 0.15 | Bal. | <0.2 |
| 4-020 | 59.46 | 0.68 | 0.17 | 0.015 | 0.12 | 0.001 | | 0.12 | | 0.03 | 0.14 | Bal. | <0.2 |

The lead-free alloys of present invention has its test result shown in the following tables:

1. Cuttability Test

It is proceeded by turning and drilling the test pieces to valuate the cuttabilities of the alloys. Under the same working condition of machinery, (see table 15) attain the cutting force data by the test apparatus, and calculating the cut-indexes corresponding to the test piece C36000. The C36000 material is a well known good Pb-containing brass with excellent cuttability, which cuttability was known to 100%. The test results are shown in table 15, the cutting chips have the shape illustrated in FIG. 1.

TABLE 15

The machinery condition for valuing cutting ability

| Lath type | Outside diameter (mm) | Cutting depth (mm) | Feed (mm/r) | Cutting speed (m/min) | Main shaft rotating speed (r/min) | Cutting points (point) | Condition |
|---|---|---|---|---|---|---|---|
| CA6140 | Φ4.75 | 0.5 | 0.08 | 16.713 | 1120 | 3 | dry |

TABLE 16

The results of valuation of cutting ability

| Alloy | machinability index (%) |
|---|---|
| C36000 alloy | 100 |
| The first invention alloy | 74.4 (selenium-free) 90.36 (selenium-contained) |
| The second invention alloy | 96.21 |
| The third invention alloy | 101.69 |
| The fourth invention alloy | 89.58 |

Note:

Cuttability index = (the resistance of cutting of C36000/the resistance of cutting of each invention alloy) × 100%. Wherein, each of resistance value of cutting is a measured mean value. The results of table 16 gives us the information that the machinability of the second invention alloys is very near to the conventional brass alloy C36000, and the machinability of the third invention alloy. Besides C36000, the alloys of present invention had been compared with that of theCu—Zn—Bi alloys produced by NAKAYAMA Co. of America and that of the Cu—Zn—Si alloys produced by Sambo Copper Alloy Co., Ltd of Japan by turning and drilling machining. The results about the comprehensive cuttabilities obtained through the comparisons are listed in the table 17.

TABLE 17

The comparisons of and the comprehensive cuttabilities between contrast alloys and the alloys of the present invention

| | Alloy | | | | | | |
|---|---|---|---|---|---|---|---|
| | | Cu—Zn—Bi | Cu—Zn—Si alloy of Sambo | Cu—Zn—Sb alloy of Ningbo Powerway Group Co., Ltd | | | |
| machinability | conventional C36000 alloy | alloy of Nakayama Co. of America | Copper Alloy Co., Ltd of Japan | The first invention alloy | The second invention alloy | The third invention alloy | The fourth invention alloy |
| Cutting Scraps with a cutting depth of 0.5 mm | Fine needle straight short discontinuous chips | Fine needle helicoidal short discontinuous chips | Oblate fine needle arc-type short discontinuous chips | Oblate fine helicoidal short discontinuous chips | Oblate fine needle circular arc-type short discontinuous chips | Fine needle hooked short discontinuous chips | Fine needle arc-type short discontinuous chips |
| Drilling Scraps with a drill of Φ3.2 mm, annealed samples | Fine needle helicoidal short discontinuous chips | Fine needle helicoidal short discontinuous chips | Fine needle flaky short discontinuous chips | Oblate fine helicoidal extremely short discontinuous chips | Fine needle arc-type short discontinuous chips | Fine needle straight extremely short discontinuous chips | Fine needle small arc-type short discontinuous chips |
| Synthetic (%) | 100 | ≧75 | ≧86 | ≧74 (不含Se) ≧90 (含Se) | ≧96 | ≧101 | ≧89 |

The results from table 17 indicate that the cuttabilities of the alloys of present inventions are near to the conventional Pb-containing alloy C36000, and superior to the alloys produced by Japan and America.

2. The Hot Compression Tests

In the hot compression tests the samples are taken from the finished products of the first to fourth invention alloys, and the contrast sample is same sized and shaped, 8 mm in outside diameter and 20 mm in length. During the test in its progressing the samples are heated under the temperature of 670° C. for 30 minutes, then being compressed to 70% along the axial direction, enabling the length to be decreased from 20 mm to 6 mm. The consequent procedure is to inspect the cracking under the deformation using magnifying lens with the magnifying power from 5 to 10 times.

As the results of the hot compression tests, it was confirmed that the first to fourth invention alloys are equal to or superior to the conventional alloy C36000 in hot workability, because no cracks were seen on the test samples of the present invention alloy and the sample of C36000 alloy. So, the first to fourth invention alloys are equal or better to the contrast Pb-containing copper alloy in hot workability. And all are suitable for industrial machining.

3. Dezincification Test

The dezincification tests were carried out to study the dezincification of the first to fourth invention alloys in comparison with the conventional alloy C36000. The dezincification tests were conducted through the following way:

The samples of finished products were prepared, which is sized 4.75 mm in out diameter and 15 mm in length. The samples were dipped in trichlorethylene and then polished with emery-cloth No. 1200, finally washed in distilled water and dried. Then each test sample was threaded and suspended in an Erlenmeyer flask filled with $CuCl_2$ with concentration of 1%. The quantity needed by each sample ranges from 250 ml to 500 ml. The Erlenmeyer flask was sealed by rub plug, the oxygen supplying is adopted a sealed manner, which was put into a constant temperature bath for 24 hours and to be maintained at 75° C. After bathing the samples was taken out, and washed by hydrochloric acid by putting it into hydrochloric acid to cleaning the surface thereof, till the copper matrix surface can be seen, the washing was stopped. Then the washing solution was poured back into the Erlenmeyer flask. The consequent procedure is measuring the content of Cu, Zn, and calculating the dezincification coefficient. The calculated dezincification coefficient is listed in the table 18.

TABLE 18

The comparison of Dezincification coefficient

| Alloy | dezincfication coefficient |
|---|---|
| C36000 alloy | 8.814 |
| The first invention alloy | 8.316 |
| The second invention alloy | 0.133 |
| The third invention alloy | 0.163 |
| The fourth invention alloy | 7.031 |

As we all know, the larger a dezincification coefficient is, the better dezincification corrosion resistance of an alloy will be. As is clear from Table 18, the first to fourth invention alloys are superior to the conventional alloy C36000 in dezincification corrosion resistance.

4. The Stress Corrosion Cracking Tests

The stress corrosion cracking tests were also carried out to evaluate the stress corrosion resistance of the first to fourth invention alloys in comparison with the conventional alloy C36000. The stress corrosion cracking tests were conducted in the following way:

The finished product test samples of the first to fourth invention alloys sized 4.75 mm in outside diameter and 150 mm in length were prepared, and washed firstly by trichlorethylene and then washed in sulphuric acid with concentration of 5%, and washed by distilled water and dried. After that the washed samples were fumigated in an ammonia environment, the PH value of the aqueous ammonia is 9.5, fumigating time is 24 hours, after finished fumigating the samples washed again in the sulphuri acid with concentration of 5%, then washed with distilled water, and heated to dry, and inspecting the cracks under a magnifier of 10 magnifications.

As the results of the stress corrosion cracking tests, it was evidenced that the first to fourth invention alloys are equal to or superior to the conventional alloy C36000, for no cracks were seen on the surface of the invention alloys and C36000.

5. The Test for Tension Resistance Property in Normal Temperature

The standard samples of finished product of the alloy of present invention and Pb-containing copper alloy C36000, which have its outside diameter of 12.5 mm and 140 mm in the length, are taken to conduct the test for measuring the tension strength and the malleability. The data measured in the test are listed in table 19.

TABLE 19

The contrast of mechanical property

| Alloy | size/condition | Elongation (%) | tensile strength ($N/mm^2$) |
|---|---|---|---|
| C36000 alloy | Φ12.5Y/2 | 16 | 526 |
| The first invention alloy | Φ12.5Y/2 | 10 | 572 |
| The second invention alloy | Φ12.5Y/2 | 18 | 527 |
| The third invention alloy | Φ12.5Y/2 | 20 | 502 |
| The fourth invention alloy | Φ12.5Y/2 | 19 | 493 |

As is indicated in Table 19, it was confirmed that the second and the third and the fourth invention alloys are superior to the conventional alloy C36000 in their tension rate and also in its tensile strength. The second invention alloy is equally to the conventional alloy C36000 in its tensile strength.

6. Test for Conductibility

The samples of alloy of present invention and Pb-containing copper alloy C36000 are taken to conduct the test of conductibility, the conductibility measured in the room temperature are listed in table 20:

TABLE 20

The contrast of electric conductibility

| Sample number | IACS(%) |
|---|---|
| C 36000 | 23.64 |
| Alloy of first invention | 15.81 |
| Alloy of second invention | 24.04 |
| Alloy of third invention | 14.41 |
| Alloy of fourth invention | 25.92 |

7. Differential Thermal Analysis (DTA)

The samples of alloy of present invention and Pb-containing copper alloy C36000 are taken to conduct the test of DTA, the melting-points measured are listed in table 21:

TABLE 21 the contrast of melting points

| Sample number | Melting point |
|---|---|
| C 36000 | 900 |
| Alloy of first invention | 909 |
| Alloy of second invention | 911.9 |
| Alloy of third invention | 902 |
| Alloy of fourth invention | 924.4 |

8. The Wear-Resist Tests

The wear-resist tests were conducted in comparison with the conventional Pb-containing alloy C3604 in this way: the draw-bar test pieces (finished products) of the first to fourth invention alloys are utilized in the test in comparison with C3604 with 7.8 mm in outside diameter. The data presented in the table 22 are obtained as the average values of the absorbed energy, frictional coefficient, amount of wear after running 1000 turns, each 2000 turns is taken into account to be a period of the test. The results are shown in Table 22.

TABLE 22 the contrast of wear resistance

| Alloy | Load (Mpa) | Speed (RPM) | Energy-absorbed ($J/cm^3$) | frictional coefficient | Amount of wear |
|---|---|---|---|---|---|
| C3604 | 2.5 | 2000 | 10286 | 0.61 | 115.2 |
| First invention | 2.5 | 2000 | 10900 | 0.83 | 4.9 |
| Second invention | 2.5 | 2000 | 9900 | 0.70 | 5.2 |
| Third invention | 2.5 | 2000 | 8069 | 0.75 | 21.5 |
| Fourth invention | 2.5 | 2000 | 9454 | 0.83 | 5.0 |

As is indicated by the results of the wear tests reported in Table 22, it was evidenced that the first to fourth invention alloys are superior to the conventional alloy C36000 in wear resistance.

9. Electrochemical Corrosion Tests

Electrochemical corrosion tests were conducted to study the corrosion resistance of the first to fourth invention alloys in comparison with the conventional Pb-containing alloy C3604. The tests were conducted in this way: the draw-bar with outside diameter 7.8 mm are utilized as the test pieces of the first to fourth invention alloys; the laboratory device is a station manufactured by Solartron Ltd. in U.K., which is a electrochemical laboratory station modeled S11287; the corrosive medium was a 3.5% aqueous solution of sodium chloride while the room temperature was 15° C. The results are shown in Table 23.

TABLE 23

Contrast of corrosion compared with C3604

| Alloy of present invention | Speed of corrosion |
|---|---|
| The alloy of first invention | $2.8366 \times 10^{-2}$ |
| The alloy of second invention | $3.0157 \times 10^{-2}$ |
| The alloy of third invention | $1.0316 \times 10^{-2}$ |
| The alloy of fourth invention | $9.2723 \times 10^{-2}$ |
| C3604 | $11.942 \times 10^{-2}$ |

As is indicated by the results of electrochemical corrosion tests reported in Table 23, it was evidenced that the first to fourth invention alloys are superior to the conventional alloy C3604 in corrosion resistance.

10. Hygienic Safety Tests

According to ⌈the enacted drinking-water regulation on valuation of hygienic safety in the piping installations and materials of drinking-water supply system ⌋ (2001), the test and check was conducted for the third invention alloy, it is a leaching test conducted to test the leaching amount of Cu, Zn, and Sb in drinking-water, the results are shown in Table 24. Table 24.

TABLE 24

The results of the hygienic safety tests

| Number | Analysis item | Requirement of hygienic safety | Conclusion of the test |
|---|---|---|---|
| 1 | Cu | Amount increased ≦ 0.2 mg/L | ok |
| 2 | Sb | Amount increased ≦ 0.0005 mg/L | ok |
| 3 | Zn | Amount increased ≦ 0.2 mg/L | ok |

On account of the results of various tests as described above, it is evidenced that as compared with conventional alloy the first to fourth invention alloys can provide similar machinability, and are equal to or superior to the present bismuth-containing and silicon-containing (content Si is 3%) brass on cuttability. The present invention alloys are developed based on a distinctive machinability strengthening mechanism. The composition of the phases is also differs from other alloys.

It is also evidenced by the results of various tests described that the present invention are the lead-free free-cutting copper-antimony alloys with excellent machinability and mechanical properties, wear resistance and corrosion resistance. Compared with of the same class of lead-free Cu—Zn—Bi alloy of American made, the cost of the materials for mass production decreases by 5%. And compared with the Pb-less Cu—Zn—Si copper alloy produced by Sanbao KK of Japan, the cost is lower than about 10%. But it is higher than the cost of conventional Pb-containing brass C36000 by 2%.

Therefore, the present invention alloys are lead-free free-cutting copper-antimony alloys with excellent machinability, wear resistance, corrosion resistance and favorable strength. They could widely utilized in hardware parts, forgings, castings and other fasteners that need high strength and good wear resistance, in the parts of hydraulic apparatus, castings, valves, faucets, taps in water supply system, and in connecting parts of heat exchanger, in lighting fixtures, in nozzles of gas oven etc.

What is claimed is:

1. The lead-free free-cutting antimony copper alloy wherein the alloy consisting of (in percentage of weight): 55 to 65 Cu; 0.4 to 1.8% Sb, 0.3 to 1.5% Si, 0.0004 to 0.12% B, at least two elements ranging from 0.2 to 1.2% and selected from the group consisting of Fe, Sn, Ni, Re, P, Mn, Al, Li, and the balance is Zn with unavoidable impurities, wherein the content of (Cu %+Zn %) is above 97% and less than 100%, the content of Zn is above 33%.

2. The lead-free free-cutting antimony alloy of claim 1 wherein the alloy consisting of (in percentage of weight): 57 to 64% Cu, 0.6 to 1.2% Sb, 0.3 to 1.0% Si, 0.0005 to 0.015% B, at least two elements among 0.2 to 1.0% and selected from the group consisting of Fe, Sn, Ni, Re, P, Mn, Al, Li, and the balance is Zn with unavoidable impurities, the content (Cu %+Zn %) is from 97% to 99%, wherein the content Zn is above 33%.

3. The lead-free free-cutting antimony copper alloy of claim 1, wherein Pb as an unavoidable impurities, the content of Pb does not exceed 0.03% in percentage by weight.

4. A method of manufacturing of the lead-free free-cutting antimony copper alloy of claim 1 comprising:

utilizing a covering protective method to enable the antimony to rapidly dissolve in the molten brass and form intermetallic compounds;

then, a continuous casting processed at a temperature of about 1030° C. to form antimony brass casting bulks, the highest processing temperature of said casting does not exceed 1100° C.;

then, a process of extrusion with a great rate of extruding being held in the temperature ranging from 630° C. to 720° C.;

an intermediate heat treatment followed, which processed under a temperature ranging from 420° C. to 720° C.;

finally, an annealing being processed at a temperature of less than 400° C.

5. The lead-free free-cutting antimony copper alloy of claim 2 wherein Pb as an unavoidable impurities, the content of Pb does not exceed 0.03% in percentage by weight.

* * * * *